US005396560A

United States Patent [19]

Arcos et al.

[11] Patent Number: 5,396,560

[45] Date of Patent: Mar. 7, 1995

[54] HEARING AID INCORPORATING A NOVELTY FILTER

[75] Inventors: John T. Arcos, Long Beach; Mark T. Core, Placentia; James G. Harrison, Cypress, all of Calif.

[73] Assignee: TRW Inc., Redondo Beach, Calif.

[21] Appl. No.: 40,709

[22] Filed: Mar. 31, 1993

[51] Int. Cl.[6] ..... H04R 25/00

[52] U.S. Cl. ..... 381/68; 381/68.4; 381/94

[58] Field of Search ..... 381/107, 108, 82, 83, 381/74, 92, 94, 68.2, 68.4, 68, 57

[56] References Cited

U.S. PATENT DOCUMENTS

| | | | |
|---|---|---|---|
| 3,814,856 | 6/1974 | Dugan | 381/73.1 |
| 3,818,149 | 6/1974 | Stearns et al. | 381/68 |
| 4,771,472 | 9/1988 | Williams, III et al. | 381/94 |
| 5,067,157 | 11/1991 | Ishida et al. | 381/13 |
| 5,144,675 | 9/1992 | Killion et al. | 381/68.4 |

OTHER PUBLICATIONS

FET principles, experiments, and projects, by Eward M. Noll, first printing 1975, 2nd edition pp. 221, 222.

*Primary Examiner*—Curtis Kuntz
*Assistant Examiner*—Huyen D. Le

[57] ABSTRACT

This invention discloses a hearing aid including one or more amplification channels in which each amplification channel includes a bandpass filter establishing the frequency range of that particular channel. Each amplification channel further includes a variable gain amplifier, a short-term energy averaging circuit, a long-term energy averaging circuit and a difference amplifier. An acoustical signal sensed by a microphone associated with the hearing aid is applied to the bandpass filter which then applies a signal within the particular frequency range of that filter to the variable gain amplifier and the short-term energy averaging circuit. An output from the variable gain amplifier is applied to the long-term energy averaging circuit and an earphone for enabling a hearing aid user to perceive the sounds sensed by the microphone. Steady state signals perceived by the microphone are integrated by the long-term energy averaging circuit which causes the difference amplifier to reduce the gain of the variable gain amplifier, thus decreasing the steady state sound. A novel sound sensed by the microphone is integrated by the short-term energy averaging circuit which causes the difference amplifier to increase the gain of the variable gain amplifier. In this manner, the gain of the amplifier is increased for desirable sounds and decreased for background noise.

19 Claims, 2 Drawing Sheets

HEARING AID INCORPORATING A NOVELTY FILTER

BACKGROUND OF THE INVENTION

1. Field of the Invention

This invention relates generally to a hearing aid and, more particularly, to a hearing aid incorporating a novelty filter providing adaptable gain in a plurality of channels.

2. Discussion of the Related Art

Conventional hearing aids come in a variety of shapes and styles. Typically, however, every hearing aid will consist of a microphone, an amplifier, and an ear phone, sometimes known as a driver. The microphone will be directed towards the environment and the ear phone will be directed towards a user's ear drum such that environmental sounds sensed by the microphone will be amplified by the amplifier and delivered to the ear phone to enable the user to perceive these sounds. More sophisticated hearing aid models may incorporate several channels of amplification, each channel being assigned a particular frequency band by a bandpass filter within the normal hearing range. Whatever designs and features a hearing aid incorporates, a number of problems must be addressed in design. Typical problems encountered by a hearing aid user include feedback between the microphone and the ear phone, inappropriate gain settings of the amplifier in one or more of the channels, and poor battery life.

Feedback occurs due to the fact that the hearing aid is a high gain (30 dB or more) device in which the microphone and the ear phone are generally spaced less than one inch apart from each other within a common housing. When a hearing aid is fitted to a particular user, usually the seal between the hearing aid housing and the user's ear canal ensures acoustic isolation between the microphone and the earphone, thus substantially eliminating feedback. However, through normal use of the aid and age of the user, certain factors, such as the shape of the ear canal, cause loss of isolation between the microphone and the earphone, thus producing feedback. Consequently, the hearing aid may have to be replaced or readjusted.

Many conventional hearing aids use a number of channels of amplification having a fixed gain setting for each channel. Typically, the gain is preset by the hearing aid dealer or audiologist. Environmental acoustics or high levels of noise may all conspire to make gain settings which are ideal at the hearing aid dealer's office inappropriate for the particular idiosyncracies of the user's environment. Consequently, since the gain is preset, a hearing aid user will not realize the most desirable gain for each channel of the hearing aid in the environments the user may encounter. Additionally, each amplification channel amplifies not only the desirable sounds, but those of unwanted background noise as well. Certain hearing aids may, however, incorporate automatic gain control (AGC) or output limiting in which the hearing aid automatically limits the intensity of the amplification of a sound.

What is needed then is a hearing aid which compensates for feedback, and which provides an adaptively adjustable gain in each channel in order to selectively amplify desirable sounds. It is therefore an object of the present invention to provide such a hearing aid.

SUMMARY OF THE INVENTION

This invention discloses a hearing aid incorporating one or more channels of amplification in which each channel includes a novelty filter. An acoustic input is converted by a microphone associated with the hearing aid to a proportionate electrical signal which is applied to a bandpass filter associated with each channel which establishes the frequency range for that particular channel. In each channel of amplification, an output from the bandpass filter associated with that channel is applied to a variable gain amplifier, a short-term energy averaging circuit and a long-term energy averaging circuit. An output of the variable gain amplifier is applied to a summing amplifier for summing together the different channels which in turn has an output applied to an earphone. An output of both the short-term energy averaging circuit and the long-term energy averaging circuit is applied to a difference amplifier which has an output as an adjustment to the gain of the variable gain amplifier.

The long-term energy averaging circuit is an integrator which integrates the level of steady state sounds, representing background noise that does not change significantly over time, having a power spectrum with energy within the particular frequency range. An output of the long-term energy averaging circuit is applied to the variable gain amplifier such that a high long-term energy average tends to force the difference amplifier output negative, thus reducing the gain of the variable gain amplifier and reducing the level of background noise. When a novel acoustical event occurs having a varying power spectrum, such as a person speaking in the din of background noise and having energy within the frequency range, the short-term energy averaging circuit will drive the difference amplifier output more positive, thus increasing the gain of the variable gain amplifier. Consequently, novel or desirable sounds experience high gain, while steady state sounds experience low gain. In a similar fashion, feedback is sensed by each amplifier channel as a steady state sound typically within a particular amplification channel within the system. Because it is a steady state sound, the long-term energy average is increased, which reduces the gain in that particular band, thus reducing feedback.

Additional objects, advantages, and features of the present invention will become apparent from the following description and appended claims taken in conjunction with the accompanying drawings.

DETAILED DESCRIPTION OF THE PREFERRED EMBODIMENTS

The following discussion of the preferred embodiments concerning a hearing aid incorporating a novelty filter is merely exemplary in nature and is in no way intended to limit the invention or its applications or uses.

Figure 1:
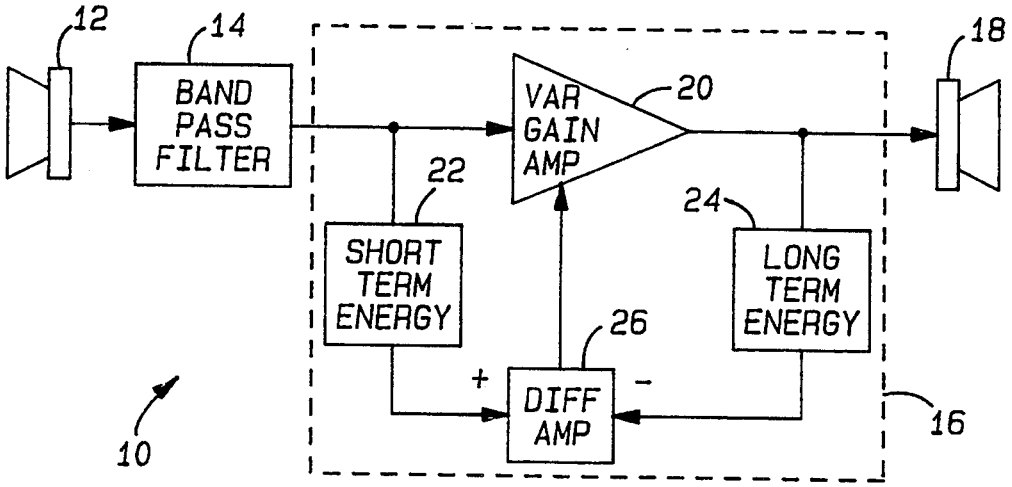
FIG. 1 is a schematic block diagram of a hearing aid according to a preferred embodiment of the present invention.

First turning to FIG. 1, a schematic block diagram of a hearing aid circuit 10 according to one preferred embodiment of the present invention is shown. The hearing aid circuit 10 includes a microphone 12 for sensing acoustical events and generating an electrical signal indicative of these events. The electrical signals from the microphone 12 are applied to a bandpass filter 14. The bandpass filter 14 filters the electrical signals and provides signals representative of a predetermined audible frequency range to an amplifier circuit 16. The amplifier circuit 16 amplifies the signals and applies them to an earphone 18, thus enabling a hearing aid user to perceive the sounds as sensed by the microphone 12. This system will be configured within a housing (not shown) adaptable to fit within an ear canal of a user. The amplification circuit 16 represents one channel of amplification, but it will be understood that typically hearing aids will include a plurality of these amplification channels, each including a separate frequency range as set by a particular bandpass filter.

The amplification circuit 16 includes a variable gain amplifier 20 and a short-term energy averaging circuit 22, both of which receive the electrical signal from the bandpass filter 14. An output of the variable gain amplifier 20 is applied to the earphone 18 and a long-term energy averaging circuit 24. Outputs from both the short-term energy averaging circuit 22 and the long-term energy averaging circuit 24 are applied to a positive and a negative input of a difference amplifier 26, respectively. The difference amplifier 26 has an output which provides control of the gain of the variable gain amplifier 20. The variable gain amplifier 20 and the difference amplifier 26 are conventional amplifiers in the art and thus, their specifics need not be discussed here. Both the short-term energy averaging circuit 22 and the long-term energy averaging circuit 24 are conventional integrators, well known to those skilled in the art, having the appropriate time constants which will integrate signals over a certain period of time. In other words, an acoustical event which has a power spectrum which does not change significantly over time, say for more than ten seconds, will be integrated by the long-term energy averaging circuit 24 in order to provide an output at the negative input of the difference amplifier 26. Likewise, the short-term energy averaging circuit 22 will have a much smaller time constant such that novel acoustical events which have power spectrums substantially continuously changing over time will be integrated and thus, the short-term energy averaging circuit 22 will provide an output at the positive input of the differential amplifier 26.

It is noted that the electrical configuration of the short-term energy averaging circuit 22 and the long-term energy averaging circuit 24 with respect to receiving the filtered signal from the bandpass filter 14 is not critical in that both of the short-term energy averaging circuit 22 and the long-term energy averaging circuit 24 can receive the electrical signal prior to being amplified by the variable gain amplifier 26. The short-term energy averaging circuit 22 should receive its input signal before the variable gain amplifier 20 to avoid an unstable positive feedback situation. Because long term energy decreases the gain of the amplifier 20, its input signal can come after the variable gain amplification by the amplifier 20 so that a stable negative feedback condition results.

In operation, the microphone 12 will sense acoustical events from the environment. The bandpass filter 14 will limit the signals to a particular range. The long-term energy averaging circuit 24 integrates acoustical events having a substantially continuous power spectrum and produces an output which tends to force the output of the difference amplifier 26 negative, thus reducing the gain of the variable gain amplifier 20. When a novel acoustic event occurs of a changing power spectrum, having energy within the range of the bandpass filter 14, the short-term energy averaging circuit 22 will provide an output signal to the difference amplifier 26 which causes the difference amplifier 26 to increase the gain of the variable gain amplifier 20. Consequently, the amplifier circuit 16 operates as a novelty filter. In this manner, novel, and generally desirable, sounds experience high gain, while steady state, generally undesirable background noise and sounds experience low gain. Therefore, a user will affectively perceive only those sounds which are desirable.

In practice, a hearing aid user in a room filled with continuous noise would experience a gradual decrease in the perceived sound as the hearing aid computed the long-term average of the noise and reduced the gain of the hearing aid accordingly. As a novel event occurred, such as a person speaking, the hearing aid would increase the gain within those channels corresponding to the frequency band of the speech, thus enabling the user to perceive the sound.

In the same manner, the amplifier circuit 16 provides automatic feedback cancellation. If feedback occurs, the feedback signal will be sensed by the amplifier circuit 16 as a steady state sound typically within a single channel of the circuit 10. Because it is a steady state sound, the feedback increases the long-term average, thus reducing the gain within that band. Reduced gain in a particular band eliminates the feedback without affecting the signals within other bands.

Figure 2:
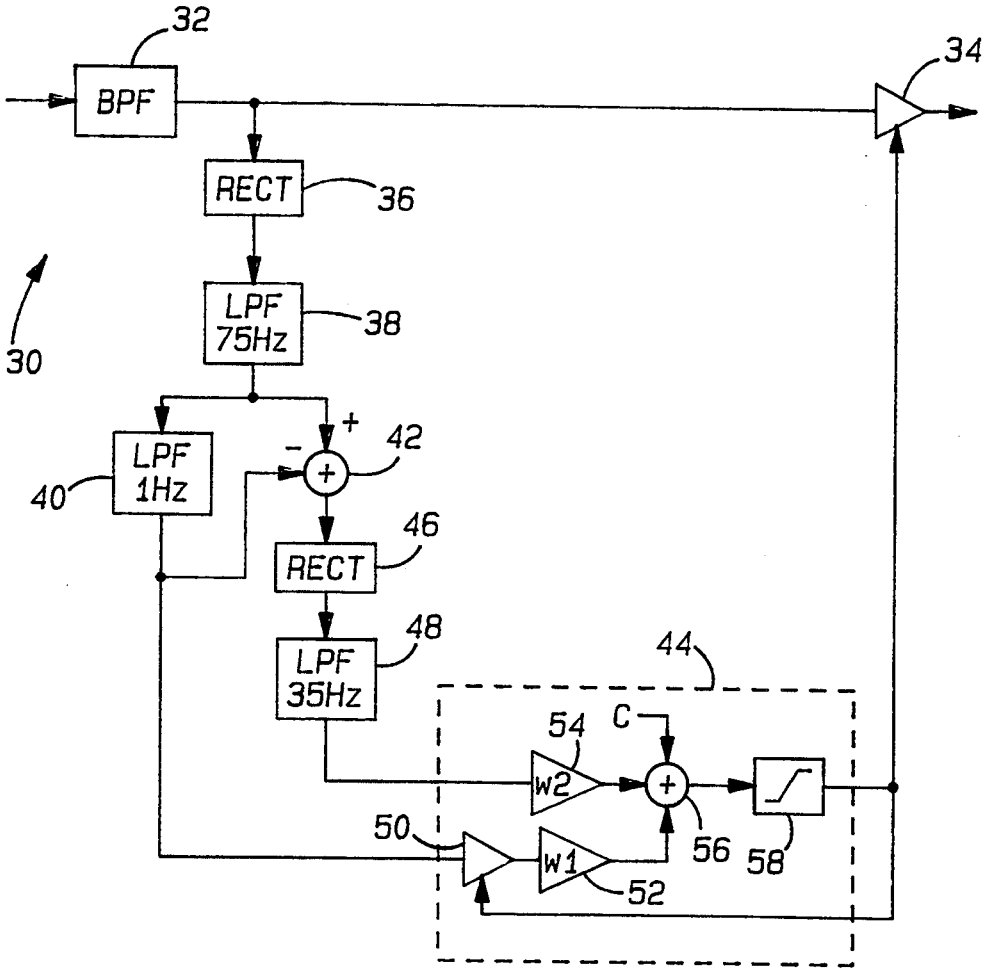
FIG. 2 is a more detailed schematic block diagram of a particular hearing aid amplification channel according to a preferred embodiment of the present invention.

Turning to FIG. 2, a more detailed illustration to that of the hearing aid circuit 10 is shown. Specifically, a hearing aid circuit 30 is shown, according to one preferred embodiment, in a schematic block diagram form in which a more detailed illustration of the amplifier circuit 16 is given. As with the hearing aid circuit 10 above, the hearing aid circuit 30 includes a bandpass filter 32 operating in the same fashion as the bandpass filter 14, and a variable gain amplifier 34 operating in the same manner as the variable gain amplifier 20, above. The microphone 12 and the speaker 18 are not shown in FIG. 2, but it will be understood that they will be included in the same manner as to that of the hearing aid circuit 10.

As above, a filtered electrical signal of an acoustical event is output from the bandpass filter 32 and applied to the variable gain amplifier 34. Additionally, this signal is also applied to a rectifier 36 and a first low pass filter 38. The rectifier 36 is provided to allow electrical current to travel in one direction, and the low pass filter 38 is provided to prevent high frequency signals from traveling to the subsequent electrical components, here signals above 75 Hz. Consequently, the combination of the rectifier 36 and the low pass filter 38 only allows signals to pass below a certain frequency. The operation and electrical configuration of rectifiers and low pass filters are well known to those skilled in the art, and therefore these devices need not be discussed in any subsequent detail.

An output signal from the low pass filter 38 is split and applied to a second low pass filter 40 and a summation junction 42. The signal output from the low pass filter 40 represents a long-term energy averaging signal and the signal output from the low-pass filter 48 represents a short-term energy averaging signal.

Once the signal from the low pass filter 38 is filtered by the low pass filter 40, here to a level below 1 Hz, it is applied to a difference amplifier circuit 44 and the summation junction 42 as a negative input. The filtered signal from the low pass filter 38 is applied to the summation junction 42 as a positive input such that the output of the summation junction 42 is a summation of the signal from the low pass filter 40 and the signal from the low pass filter 38. The output signal from the summation junction 42 is applied to a rectifier 46 and then to a third low pass filter 48 which again filters out signals above a predetermined value, here signals above 35 Hz. The output of the low pass filter 48 is applied to the difference amplifier circuit 44 as a short-term average energy input. The frequencies of the low pass filters 38, 40 and 48 are merely illustrations, and thus could be different for different applications.

Within the difference amplifier 44, the long-term average energy input from the low pass filter 40 is applied to a first operational amplifier 50 and a second operational amplifier 52. The amplifier 52 has an inverted weighting function which multiplies the signal from the amplifier 50 by a particular predetermined constant and inverts it in order to decrease the output of the difference amplifier 44. Likewise, the filtered output from the low pass filter 48 is applied to a third amplifier 54 which multiplies this signal by a predetermined weighting function in order to increase the output of the difference amplifier 44. The outputs of the amplifier 52 and the amplifier 54 are applied to a summation junction 56 for increasing and decreasing the output of the difference amplifier 44 as just described. Also applied to the summation junction 56 is an offset signal, here represented by input C. The offset signal sets a predetermined output of the difference amplifier 44 as a nominal gain.

The output of the summation circuit 56 is applied to a sigmoidal transfer function circuit 58. The transfer function circuit 58 is a saturated gain circuit which clips the output of the difference amplifier 44 to a level below a predetermined value. Transfer function circuits of this type are well known in the art, and thus do not need to be described in any detail here. The output of the difference amplifier 44 is applied to the variable gain amplifier 34 in order to adjust the output of the circuit 30 in the same manner as that discussed above for variable amplifier 20. Additionally, the output of the difference amplifier 44 is applied to the gain control of the amplifier 50 in order to adjust the long-term signal being applied to the difference amplifier 44. Also, the input to the amplifier 52 from the circuit 58 effectively provides a long term energy averaging signal from the output side of the variable gain amplifier 34.

Figure 3:
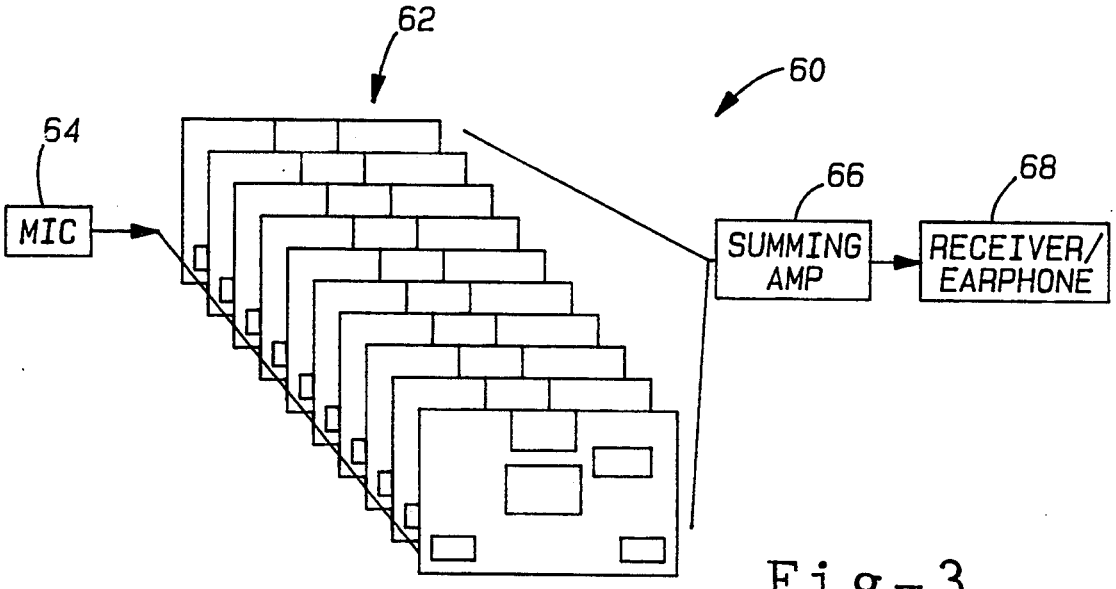
FIG. 3 is a schematic block diagram of a hearing aid incorporating a plurality of different amplification channels according to a preferred embodiment of the present invention.

FIG. 3 shows a hearing aid circuit 60 incorporating a plurality of amplification channels 62, here eleven. A microphone 64 provides an electrical signal to each of the amplification channels indicative of the acoustical event it senses. A bandpass filter (not shown) in each of the amplification channels 62 eliminates all frequencies except those desired for that channel. An output of each of the amplification channels 62 is applied to a summing amplifier 66 which adds all of the particular frequencies together. An output of the summing amplifier 66 is applied to an earphone 68, thus enabling the hearing aid user to perceive the sounds picked up by the microphone 64. Additionally, output limiting circuitry or automatic gain control can be incorporated within the summing amplifier 66 in order to provide a volume control feature.

It is generally desirable in this type of system to incorporate several amplification channels in order to provide a wider degree of resolution. Because a novel acoustical event in each channel will cause the gain of the entire channel to increase, it is desirable to provide a number of channels because background noise in other channels will not be increased as the background noise is increased in a specific channel having the range of the novel acoustical event. It is noted that the specific frequency range of each channel can be tailored to specific applications in that each different amplification channel does not have to cover a band of frequencies of the same magnitude as other channels. Consequently, a versatile hearing aid can be realized.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A hearing aid comprising:

a microphone operable to sense acoustical events and convert them to proportionate electrical signals;

a variable gain amplifier operable to amplify the electrical signals from the microphone and provide an amplified output of that signal depending on the gain of the amplifier;

a difference amplifier operable to adjust the gain of the variable gain amplifier;

a long-term energy averaging circuit operable to sense substantially steady state acoustical events received by the microphone and force the difference amplifier to reduce the gain of the variable gain amplifier in view of the steady state signals;

a short-term energy averaging circuit operable to sense novel acoustical signals received by the microphone and force the difference amplifier to increase the gain of the variable gain amplifier in view of the novel signals; and an earphone operable to receive an output signal from the variable gain amplifier and convert it to an audible sound.

2. The hearing aid according to claim 1 further comprising a plurality of amplification channels in which each amplification channel includes a bandpass filter operable to set a frequency band range of the particular amplification channel, wherein each amplification channel further includes a separate variable gain amplifier, short-term energy averaging circuit, long-term energy averaging circuit and difference amplifier.

3. The hearing aid according to claim 2 in which an output from each of the plurality of amplification channels is applied to a summing amplifier, said summing amplifier being operable to apply a summed signal to the earphone.

4. The hearing aid according to claim 1 wherein each of the long-term energy averaging circuit and the short-term energy averaging circuit are integrating circuits, wherein the long-term energy averaging circuit integrates electrical signals having a power spectrum which does not change significantly over time and the short-term energy averaging circuit integrates signals having a power spectrum that does significantly changes over time.

5. The hearing aid according to claim 1 further comprising an automatic gain control circuit operable to limit the output of the hearing aid below a predetermined intensity.

6. The hearing aid according to claim 1 wherein the difference amplifier includes a first weighting amplifier and a second weighting amplifier, said first weighting amplifier being a positively weighted amplifier for applying a positively weighted signal from the short-term energy averaging circuit to a summation junction and said second weighting amplifier being a negative weighting amplifier for providing an inverse signal from the long-term energy averaging circuit to the summation junction.

7. The hearing aid according to claim 6 wherein the difference amplifier further includes a sigmoidal transfer function circuit for providing a saturable gain limitation to the output of the difference amplifier.

8. An amplifying circuit comprising:

a variable gain amplifier receiving an input signal and providing an amplified output of the input signal depending on the gain of the amplifier;

a difference amplifier having an output which adjusts the gain of the variable gain amplifier;

a long-term energy averaging circuit applying an input signal to a negative input of the difference amplifier for decreasing the gain of the variable gain amplifier, said long-term energy averaging circuit integrating substantially steady state signals of the input signal; and a short-term energy averaging circuit applying an input signal to a positive input of the difference amplifier for increasing the gain of the variable gain amplifier, said short-term energy averaging circuit integrating novel signals of the input signal.

9. The amplifying circuit according to claim 8 wherein the amplification circuit is associated with a hearing aid device, wherein the hearing aid device includes a microphone which senses acoustical events from the environment and converts them to electrical signals and applies the electrical signals as the input signal to the variable gain amplifier, said hearing aid further including an earphone which receives an output from the variable gain amplifier and converts it to an audible sound to be perceived by a hearing aid user.

10. The amplifying circuit according to claim 8 further comprising a bandpass filter, said band pass filter limiting the input to the variable gain amplifier to a predetermined frequency range.

11. The amplifying circuit according to claim 8 wherein each of the long-term energy averaging circuit and the short-term energy averaging circuit are integrating circuits, wherein the long-term energy averaging circuit integrates electrical signals having a power spectrum which does not change significantly over time and the short-term energy averaging circuit integrates signals having a power spectrum that does significantly changes over time.

12. The amplifying circuit according to claim 8 wherein the difference amplifier includes a first weighting amplifier and a second weighting amplifier, said first weighting amplifier being a positively weighted amplifier for applying a positively weighted signal from the short-term energy averaging circuit to a summation junction and said second weighting amplifier being a negative weighting amplifier for providing an inverse signal from the long-term energy averaging circuit to the summation junction.

13. A method of amplifying an acoustical event, said method comprising the steps of:

converting the acoustical event to a proportionate electrical signal:

applying the electrical signal as an input to a variable gain amplifier in order to amplify the signal depending on the gain of the amplifier;

applying an output from a difference amplifier to the variable gain amplifier in order to adjust the gain of the variable gain amplifier;

applying an output from a long-term energy averaging circuit to a negative input of the difference amplifier, wherein the long-term energy averaging circuit senses steady state portions of the signal in order to force the difference amplifier to reduce the gain of the variable gain amplifier;

applying an output from a short-term energy averaging circuit to a positive input of the difference amplifier, wherein the short-term energy averaging circuit integrates novel portions of the signal in order to force the difference amplifier to increase the gain of the variable gain amplifier; and converting an output of the variable gain amplifier to a proportionate acoustical signal.

14. The method according to claim 13 wherein the step of converting the acoustical event to an electrical signal includes using a microphone to sense the acoustical events and convert them to the electrical signals.

15. The method according to claim 13 wherein the step of converting the output of the variable gain amplifier includes using an earphone to convert the output from the variable gain amplifier to an audible sound.

16. The method according to claim 13 further comprising the step of applying the converted electrical signal to a plurality of channels, each of the channels including a band pass filter for limiting the frequencies of each channel to a particular frequency range, each channel further including a variable gain amplifier, a difference amplifier, a short-term energy averaging circuit, and a long-term energy averaging circuit.

17. The method according to claim 16 further comprising the step of applying an output from each of the channels to a summing junction prior to the electrical signals being converted to the acoustical signal.

18. The method according to claim 13 further comprising the step of applying the electrical signal to an automatic gain control circuit for limiting the output intensity of the signal.

19. The method according to claim 13 wherein the long-term energy averaging circuit integrates electrical signals having a power spectrum which does not significantly change over time and the short-term energy averaging circuit integrates signals having a power spectrum that does change over time.

* * * * *

US005396560C1

(12) EX PARTE REEXAMINATION CERTIFICATE (8958th)

United States Patent
Arcos et al.

(10) Number: US 5,396,560 C1
(45) Certificate Issued: Apr. 17, 2012

(54) HEARING AID INCORPORATING A NOVELTY FILTER

(75) Inventors: John T. Arcos, Long Beach, CA (US); Mark T. Core, Placentia, CA (US); James G. Harrison, Cypress, CA (US)

(73) Assignee: Northrop Grumman Systems Corporation, Los Angeles, CA (US)

Reexamination Request:
No. 90/011,192, Oct. 8, 2010

Reexamination Certificate for:

| | |
|---|---|
| Patent No.: | **5,396,560** |
| Issued: | **Mar. 7, 1995** |
| Appl. No.: | **08/040,709** |
| Filed: | **Mar. 31, 1993** |

(51) Int. Cl.
*H04R 25/00* (2006.01)

(52) U.S. Cl. ..... 381/68; 381/68.4; 381/94
(58) Field of Classification Search ..... None
See application file for complete search history.

(56) References Cited

To view the complete listing of prior art documents cited during the proceeding for Reexamination Control Number 90/011,192, please refer to the USPTO's public Patent Application Information Retrieval (PAIR) system under the Display References tab.

*Primary Examiner*—My-Trang Nu Ton

(57) ABSTRACT

This invention discloses a hearing aid including one or more amplification channels in which each amplification channel includes a bandpass filter establishing the frequency range of that particular channel. Each amplification channel further includes a variable gain amplifier, a short-term energy averaging circuit, a long-term energy averaging circuit and a difference amplifier. An acoustical signal sensed by a microphone associated with the hearing aid is applied to the bandpass filter which then applies a signal within the particular frequency range of that filter to the variable gain amplifier and the short-term energy averaging circuit. An output from the variable gain amplifier is applied to the long-term energy averaging circuit and an earphone for enabling a hearing aid user to perceive the sounds sensed by the microphone. Steady state signals perceived by the microphone are integrated by the long-term energy averaging circuit which causes the difference amplifier to reduce the gain of the variable gain amplifier, thus decreasing the steady state sound. A novel sound sensed by the microphone is integrated by the short-term energy averaging circuit which causes the difference amplifier to increase the gain of the variable gain amplifier. In this manner, the gain of the amplifier is increased for desirable sounds and decreased for background noise.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-19 are cancelled.

* * * * *